US008247989B2

(12) United States Patent
Chuang et al.

(10) Patent No.: US 8,247,989 B2
(45) Date of Patent: Aug. 21, 2012

(54) LAMP DETECTION DRIVING SYSTEM AND RELATED DETECTION DRIVING METHOD

(75) Inventors: Wei-Chung Chuang, Hsin-Chu (TW); Yung-Lung Hsuao, Hsin-Chu (TW); Shih-Ping Chou, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 989 days.

(21) Appl. No.: 12/245,773

(22) Filed: Oct. 6, 2008

(65) Prior Publication Data

US 2010/0013415 A1 Jan. 21, 2010

(30) Foreign Application Priority Data

Jul. 17, 2008 (TW) ..... 97127151 A

(51) Int. Cl.
*H05B 37/02* (2006.01)

(52) U.S. Cl. ..... 315/291; 315/307; 315/308

(58) Field of Classification Search ..... 315/301, 315/307–311, 291
See application file for complete search history.

(56) References Cited

U.S. PATENT DOCUMENTS 5,936,361 A 8/1999 Yamashita
6,150,772 A * 11/2000 Crane ..... 315/291
6,259,615 B1 * 7/2001 Lin ..... 363/98
6,510,995 B2 * 1/2003 Muthu et al. ..... 235/454
6,936,975 B2 * 8/2005 Lin et al. ..... 315/224
7,315,136 B1 * 1/2008 Chen et al. ..... 315/282
2002/0180380 A1 * 12/2002 Lin ..... 315/224
2006/0284576 A1 12/2006 Le
2007/0195025 A1 * 8/2007 Korcharz et al. ..... 345/82
2008/0012510 A1 * 1/2008 Po ..... 315/308

FOREIGN PATENT DOCUMENTS

CN 101109855 A 1/2008
JP 2005174909 6/2005
TW 245150 12/2005

* cited by examiner

*Primary Examiner* — Douglas W Owens
*Assistant Examiner* — Amy Yang
(74) *Attorney, Agent, or Firm* — Winston Hsu; Scott Margo

(57) ABSTRACT

A lamp detection driving system is disclosed for performing adaptive lamp driving and related detection operations based on a recipe. The system includes a micro-controller, a driver, a defect detection module and a feedback circuit. The micro-controller provides a modulation signal and a plurality of reference signals based on the recipe. The driver generates at least one driving signal for driving at least one lamp based on the modulation signal. The feedback circuit generates a plurality of feedback signals based on lamp currents or lamp voltages. The defect detection module generates a plurality of detection signals based on the reference signals and the feedback signals. Furthermore, disclosed is a lamp detection driving method including downloading the recipe, generating at least one driving signal for driving at least one lamp based on the recipe, and providing at least one reference signal for performing defect detection processes based on the recipe.

21 Claims, 9 Drawing Sheets

LAMP DETECTION DRIVING SYSTEM AND RELATED DETECTION DRIVING METHOD

BACKGROUND OF THE INVENTION

1. Field of the Invention

The present invention relates to a lamp detection driving system and related detection driving method, and more particularly, to a lamp detection driving system and related detection driving method for performing adaptive lamp driving and related detection operations based on a recipe.

2. Description of the Prior Art

Because liquid crystal display (LCD) devices are characterized by thin appearance, low power consumption, and low radiation, LCD devices have been widely applied in various electronic products for panel displaying. In general, the LCD device comprises liquid crystal cells encapsulated between two substrates and a lighting module for providing a light source. The operation of an LCD device is featured by varying voltage drops between opposite sides of the liquid crystal cells for twisting the angles of the liquid crystal molecules of the liquid crystal cells so that the transparency of the liquid crystal cells can be controlled for illustrating images with the aid of the lighting module.

The lighting module of an LCD device is normally disposed at the lower or lateral sides of the LCD panel of the LCD device. The lighting module in conjunction with various optical devices (such as diffusers and prisms) is able to provide a high-intensity and uniform light source for the LCD panel. That is, based on the voltage drops between opposite sides of the liquid crystal cells of the LCD panel with the aid of the uniform light source, the luminance and chromaticity of panel pixels can be controlled precisely so that the LCD device is capable of displaying high-quality images. The lighting module comprises at least one lamp. The lamp can be a cold-cathode fluorescent lamp (CCFL) or an external electrode fluorescent lamp (EEFL). Since the lamp performance of the lighting module has a significant effect on the display quality of the LCD device, the lamp detection operation has become a crucial process in the production line of the lighting module for removing any flawed lamp in a real time.

Accordingly, the performance of a lamp detection driving system for detecting the lighting module is directly corresponding to the efficiency and quality assurance (QA) of the production line. However, the lamp sizes, the lamp quantities, the lamp driving frequencies, or the lamp driving currents of different lighting modules may be different. For instance, the lighting module may comprise one lamp, two lamps, four lamps, or more lamps. In view of that, a variety of dedicated lamp detection driving systems are required for detecting different lighting modules. That is, in the detection process for detecting different lighting modules, mal-operations are likely to occur while switching different dedicated lamp detection driving systems manually, which results in high detection cost and low detection efficiency.

SUMMARY OF THE INVENTION

In accordance with an embodiment of the present invention, a lamp detection driving system is disclosed for performing adaptive lamp driving and related detection operations. The lamp detection driving system comprises a micro-controller unit, a driving signal control circuit, a plurality of driving circuits, a defect detection module, and a feedback circuit.

The micro-controller unit is utilized for providing a pulse width modulation (PWM) signal, a lamp current control signal and a plurality of detection reference signals based on a recipe. The driving signal control circuit is electrically coupled to the micro-controller unit and functions to generate a plurality of preliminary control signals based on the PWM signal. Each of the driving circuits is electrically coupled to the driving signal control circuit and functions to generate a driving signal based on the preliminary control signals. The driving signal is then utilized for driving a corresponding lamp. The defect detection module is electrically coupled to the micro-controller unit and functions to generate a plurality of detection signals based on the detection reference signals and a plurality of feedback signals. The feedback circuit is electrically coupled to the defect detection module and functions to generate the feedback signals based on at least one lamp current or at least one lamp voltage of at least one lamp.

The present invention further discloses a lamp detection driving method for performing adaptive lamp driving and related detection operations. The lamp detection driving method comprises downloading a recipe; generating at least one driving signal based on the recipe for driving at least one lamp; and providing at least one detection reference signal based on the recipe for performing at least one defect detection process.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3(*b*) is a schematic circuit diagram showing a second embodiment of the lamp driving turn-off circuit.

FIG. 3(*c*) is a schematic circuit diagram showing a third embodiment of the lamp driving turn-off circuit.

FIG. 3(*d*) is a schematic circuit diagram showing a fourth embodiment of the lamp driving turn-off circuit.

DETAILED DESCRIPTION

Hereinafter, preferred embodiments of the present invention will be described in detail with reference to the accompanying drawings. Here, it is to be noted that the present invention is not limited thereto. Furthermore, the step serial numbers concerning the lamp detection driving method are not meant thereto limit the operating sequence, and any rearrangement of the operating sequence for achieving same functionality is still within the spirit and scope of the invention.

Figure 1:
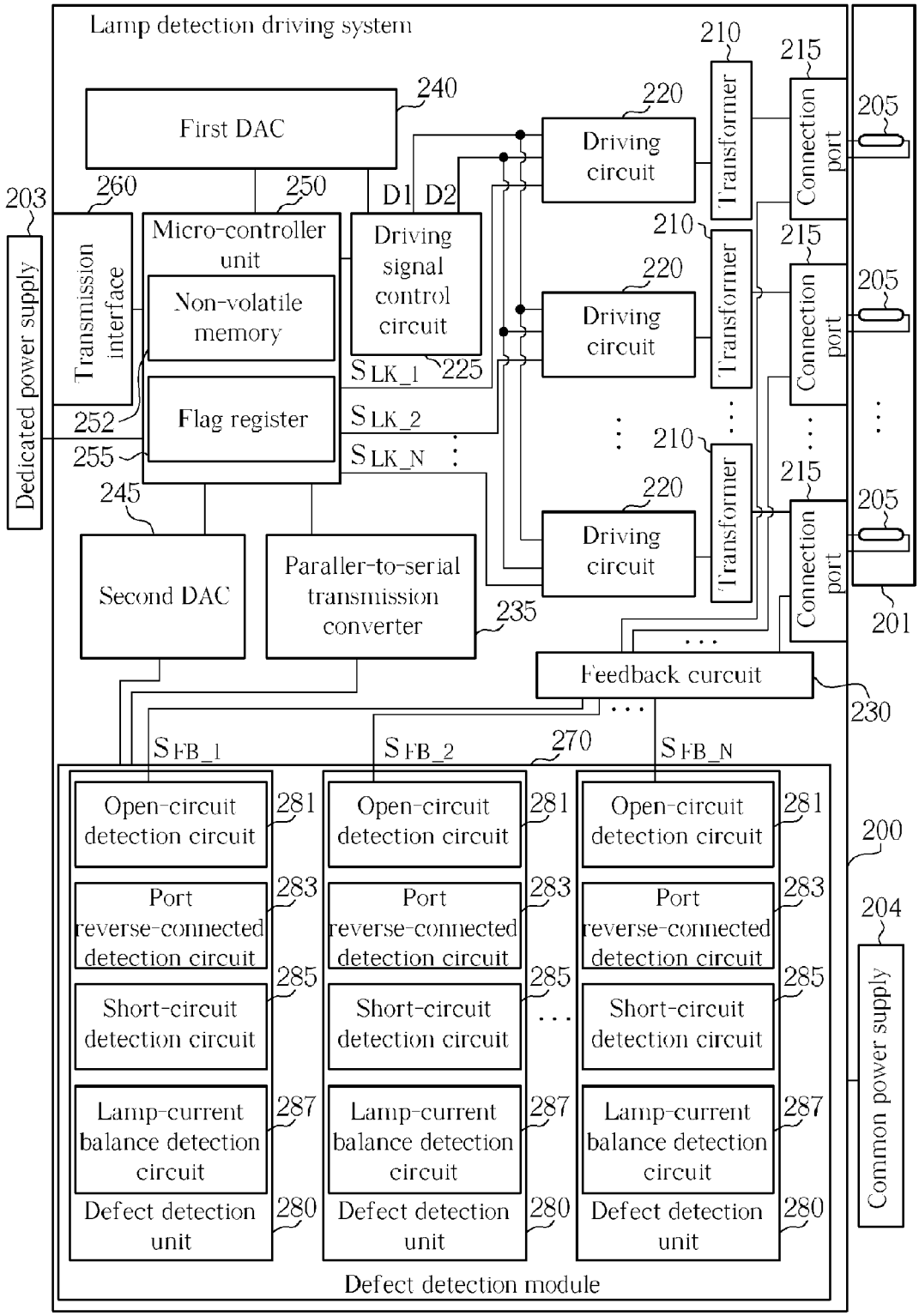
FIG. 1 is a schematic diagram showing a lamp detection driving system in accordance with a first embodiment of the present invention.

FIG. 1 is a schematic diagram showing a lamp detection driving system in accordance with a first embodiment of the present invention. As shown in FIG. 1, the lamp detection driving system 200 functions to detect a lighting module 201 having at least one lamp 205. The lamp 205 can be a cold-cathode fluorescent lamp or an external electrode fluorescent lamp. The lamp detection driving system 200 comprises a micro-controller unit 250, a driving signal control circuit 225, a plurality of driving circuits 220, a plurality of transformers 210, a plurality of connection ports 215, a transmission interface 260, a first digital-to-analog converter (DAC) 240, a second DAC 245, a feedback circuit 230, a parallel-to-serial transmission converter 235, and a defect detection module 270. The micro-controller unit 250 comprises a non-volatile memory 252 and a flag register 255. The non-volatile memory 252 can be an electrically-erasable programmable read only memory (EEPROM) or a flash memory. The defect detection module 270 comprises a plurality of defect detection units 280. Each defect detection unit 280 comprises an open-circuit detection circuit 281, a port reverse-connected detection circuit 283, a short-circuit detection circuit 285, and a lamp-current balance detection circuit 287.

The transmission interface 260 can be an I2C (Inter-integrated circuit) transmission interface or a universal asynchronous receiver/transmitter (UART). The micro-controller unit 250 is coupled to the transmission interface 260 for downloading a recipe via an I2C transmission line or via a UART-based transmission line. The recipe is stored in the non-volatile memory 252. The micro-controller unit 250 is utilized to generate a pulse width modulation (PWM) signal, a plurality of detection reference signals, and a lamp current control signal based on the recipe. Also, the micro-controller unit 250 is utilized to switch the flag value of the flag register 255 and enable a plurality of turn-off signals $S_{LK_1}$-$S_{LK_N}$ when some defect is detected. Furthermore, based on a lighting stable time provided by the recipe, the micro-controller unit 250 can be utilized to perform a delay process in the lamp detection operation. Moreover, the recipe may also provide a preset attached-lamp quantity for the micro-controller unit 250 to determine whether there is any lamp open-circuit defect detected according to the quantity of detected working lamps and the preset attached-lamp quantity. The flag register 255 is utilized for storing a flag value corresponding to the detection result regarding the lighting module 201. Accordingly, the flag value of the flag register 255 can be used to indicate whether there is any defect detected. In one embodiment, the micro-controller unit 250 is powered by a dedicated power supply 203, and the other elements of the lamp detection driving system 200 are powered by a common power supply 204 as shown in FIG. 1. In another embodiment, the micro-controller unit 250 and the other elements of the lamp detection driving system 200 are all powered by the common power supply 204. The first DAC 240 is coupled to the micro-controller unit 250 and functions to convert the lamp current control signal into an analog control signal. The micro-controller unit 250 may forward the lamp current control signal to the first DAC 240 via a transmission interface such as an 12C transmission interface or an UART. The driving signal control circuit 225 is coupled to the micro-controller unit 250 and the first DAC 240 for receiving the PWM signal and the analog control signal respectively. The driving signal control circuit 225 is utilized for generating a first preliminary control signal D1 and a second preliminary control signal D2 based on the PWM signal and the analog control signal.

Each driving circuit 220 is coupled to the driving signal control circuit 225 and functions to generate one corresponding driving signal based on the first preliminary control signal D1 and the second preliminary control signal D2. Each driving circuit 220 is further coupled to the micro-controller unit 250 for receiving one corresponding turn-off signal, and the circuit operation of the driving circuit 220 can be disabled based on the corresponding turn-off signal. Each transformer 210 is coupled to one corresponding driving circuit 220 and functions to transform one corresponding driving signal into one corresponding high-voltage driving signal. Each connection port 215 is coupled to one corresponding transformer 210 for outputting one corresponding high-voltage driving signal for driving one corresponding attached lamp 205.

The feedback circuit 230 is coupled to the plurality of connection ports 215 and functions to generate a plurality of sets of feedback signals $S_{FB_1}$, $S_{FB_2}$-$S_{FB_N}$ based on the currents and voltages of the lamps 205. Each set of feedback signals may comprise a lamp front-end current signal, a lamp rear-end current signal, and a lamp front-end voltage signal of one corresponding lamp 205. The second DAC 245 is coupled to the micro-controller unit 250 and functions to convert the detection reference signals into a plurality of analog reference signals. That is, the analog reference signals can be adjusted based on the recipe. The analog reference signals may comprise a lamp open-circuit reference signal, a high-current reference signal, a low-current reference signal, a voltage reference signal, and a reverse-connected detection reference signal. The defect detection module 270 is coupled to the feedback circuit 230 for receiving the plurality of sets of feedback signals $S_{FB_1}$, $S_{FB_2}$-$S_{FB_N}$. Furthermore, the defect detection module 270 is coupled to the second DAC 245 for receiving the analog reference signals. Each defect detection unit 280 is utilized for generating a plurality of corresponding detection signals by performing corresponding detection operations on the feedback signals of one corresponding lamp 205 with the aid of the analog reference signals. The parallel-to-serial transmission converter 235 is coupled between the defect detection module 270 and the micro-controller unit 250. The parallel-to-serial transmission converter 235 functions to convert a parallel transmission of the detection signals received from the defect detection module 270 into a serial transmission of the detection signals forwarded to the micro-controller unit 250. In another embodiment, the parallel-to-serial transmission converter 235 can be omitted, and the detection signals are forwarded from the defect detection module 270 directly to the micro-controller unit 250 in parallel.

Figure 2:
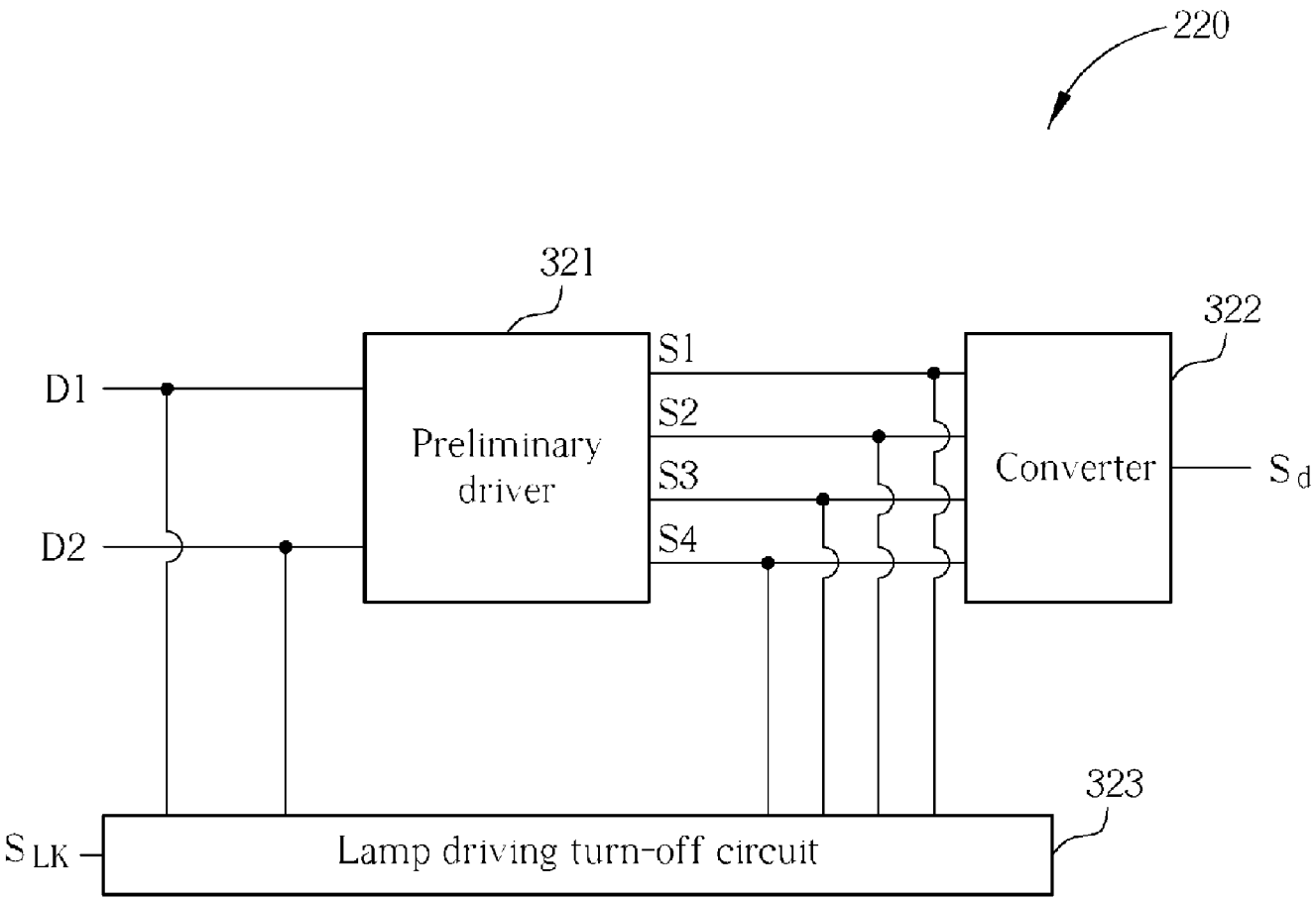
FIG. 2 is a schematic diagram showing the internal structure of the driving circuit in FIG. 1.

FIG. 2 is a schematic diagram showing the internal structure of the driving circuit in FIG. 1. As shown in FIG. 2, the driving circuit 220 comprises a preliminary driver 321, a converter 322 and a lamp driving turn-off circuit 323. The preliminary driver 321 is coupled to the driving signal control circuit 225 and functions to generate a plurality of driving control signals S1-S4 based on the first preliminary control signal D1 and the second preliminary control signal D2. The converter 322 is coupled to the preliminary driver 321 and functions to generate a driving signal Sd based on the driving control signals S1-S4. The driving signal Sd is furnished to one corresponding transformer 210 for generating one corresponding high-voltage driving signal so as to drive one corresponding lamp 205. The converter 322 can be a full-bridge inverter, a half-bridge inverter, or a push-pull inverter. The lamp driving turn-off circuit 323 is coupled to the micro-controller unit 250 for receiving one corresponding turn-off signal $S_{LK}$. Based on the turn-off signal $S_{LK}$, the lamp driving turn-off circuit 323 is able to disable the circuit operation of the driving circuit 220 by pulling down the signals D1, D2 and/or the signals S1-S4 to a ground level.

Figure 3:
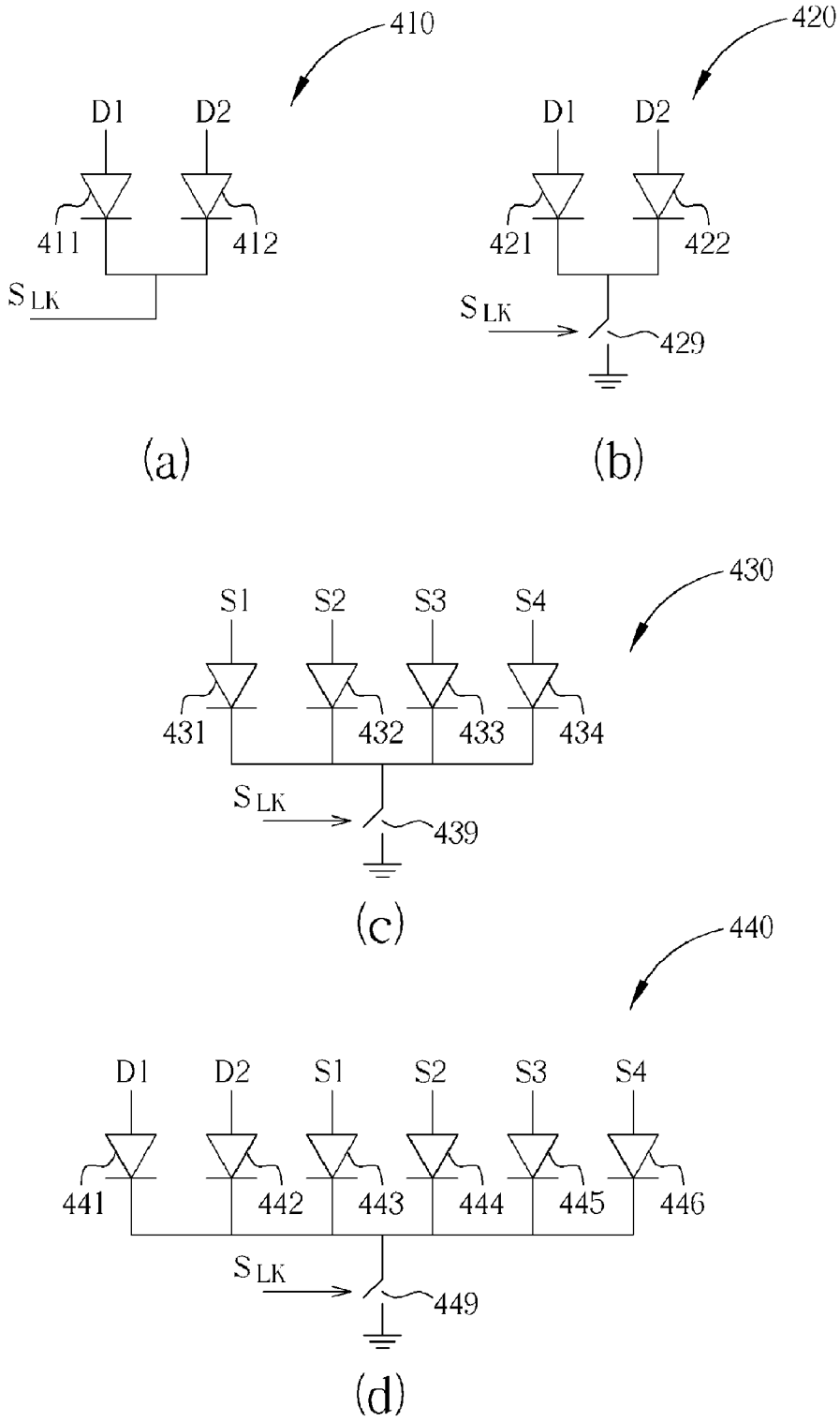
FIG. 3(*a*) is a schematic circuit diagram showing a first embodiment of the lamp driving turn-off circuit.

In one embodiment, the internal circuit structure of the lamp driving turn-off circuit 323 in FIG. 2 can be designed as the lamp driving turn-off circuit 410 shown in FIG. 3(*a*). Referring to FIG. 3(*a*), there is shown a schematic circuit diagram illustrating a first embodiment of the lamp driving turn-off circuit. The lamp driving turn-off circuit 410 comprises a first pull-down diode 411 and a second pull-down diode 412. The positive ends of the pull-down diodes 411, 412 are coupled to the driving signal control circuit 225 for receiving the first preliminary control signal D1 and the second preliminary control signal D2 respectively. Both the negative ends of the first and second pull-down diodes 411, 412 are coupled to the micro-controller unit 250 for receiving one corresponding turn-off signal $S_{LK}$. When the turn-off signal $S_{LK}$ with a low voltage level is furnished, the first preliminary control signal D1 and the second preliminary control signal D2 can be pulled down to the low voltage level via the first and second pull-down diodes 411, 412 respectively.

In another embodiment, the internal circuit structure of the lamp driving turn-off circuit 323 in FIG. 2 can be designed as the lamp driving turn-off circuit 420 shown in FIG. 3(*b*). Referring to FIG. 3(*b*), there is shown a schematic circuit diagram illustrating a second embodiment of the lamp driving turn-off circuit. The lamp driving turn-off circuit 420 comprises a first pull-down diode 421, a second pull-down diode 422, and a switch 429. The positive ends of the pull-down diodes 421, 422 are coupled to the driving signal control circuit 225 for receiving the first preliminary control signal D1 and the second preliminary control signal D2 respectively. The switch 429 comprises a first end coupled to the negative ends of the pull-down diodes 421, 422, a second end coupled to a ground, and a control end coupled to the micro-controller unit 250 for receiving one corresponding turn-off signal $S_{LK}$. When the turn-off signal $S_{LK}$ is a switch-on signal of the switch 429, the first preliminary control signal D1 and the second preliminary control signal D2 can be pulled down to the ground via the first and second pull-down diodes 421, 422 respectively. The switch 429 can be a metal oxide semiconductor (MOS) field effect transistor, a junction field effect transistor, or a bipolar junction transistor. The switch-on signal of the switch 429 can be a low-level enable signal or a high-level enable signal.

In another embodiment, the internal circuit structure of the lamp driving turn-off circuit 323 in FIG. 2 can be designed as the lamp driving turn-off circuit 430 shown in FIG. 3(*c*). Referring to FIG. 3(*c*), there is shown a schematic circuit diagram illustrating a third embodiment of the lamp driving turn-off circuit. The lamp driving turn-off circuit 430 comprises a first pull-down diode 431, a second pull-down diode 432, a third pull-down diode 433, a fourth pull-down diode 434, and a switch 439. The positive ends of the pull-down diodes 431-434 are coupled to the preliminary driver 321 for receiving the driving control signals S1-S4 respectively. The switch 439 comprises a first end coupled to the negative ends of the pull-down diodes 431-434, a second end coupled to a ground, and a control end coupled to the micro-controller unit 250 for receiving one corresponding turn-off signal $S_{LK}$. When the turn-off signal $S_{LK}$ is a switch-on signal of the switch 439, the driving control signals S1-S4 can be pulled down to the ground via the pull-down diodes 431-434 respectively. The switch 439 can be a MOS field effect transistor, a junction field effect transistor, or a bipolar junction transistor. The switch-on signal of the switch 439 can be a low-level enable signal or a high-level enable signal.

In another embodiment, the internal circuit structure of the lamp driving turn-off circuit 323 in FIG. 2 can be designed as the lamp driving turn-off circuit 440 shown in FIG. 3(*d*). Referring to FIG. 3(*d*), there is shown a schematic circuit diagram illustrating a fourth embodiment of the lamp driving turn-off circuit. The lamp driving turn-off circuit 440 comprises a first pull-down diode 441, a second pull-down diode 442, a third pull-down diode 443, a fourth pull-down diode 444, a fifth pull-down diode 445, a sixth pull-down diode 446, and a switch 449. The positive ends of the pull-down diodes 441, 442 are coupled to the driving signal control circuit 225 for receiving the first preliminary control signal D1 and the second preliminary control signal D2 respectively. The positive ends of the pull-down diodes 443-446 are coupled to the preliminary driver 321 for receiving the driving control signals S1-S4 respectively. The switch 449 comprises a first end coupled to the negative ends of the pull-down diodes 441-446, a second end coupled to a ground, and a control end coupled to the micro-controller unit 250 for receiving one corresponding turn-off signal $S_{LK}$. When the turn-off signal $S_{LK}$ is a switch-on signal of the switch 449, the control signals D1, D2 and S1-S4 can be pulled down to the ground via the pull-down diodes 441-446 respectively. The switch 449 can be a MOS field effect transistor, a junction field effect transistor, or a bipolar junction transistor. The switch-on signal of the switch 449 can be a low-level enable signal or a high-level enable signal.

Figure 4:
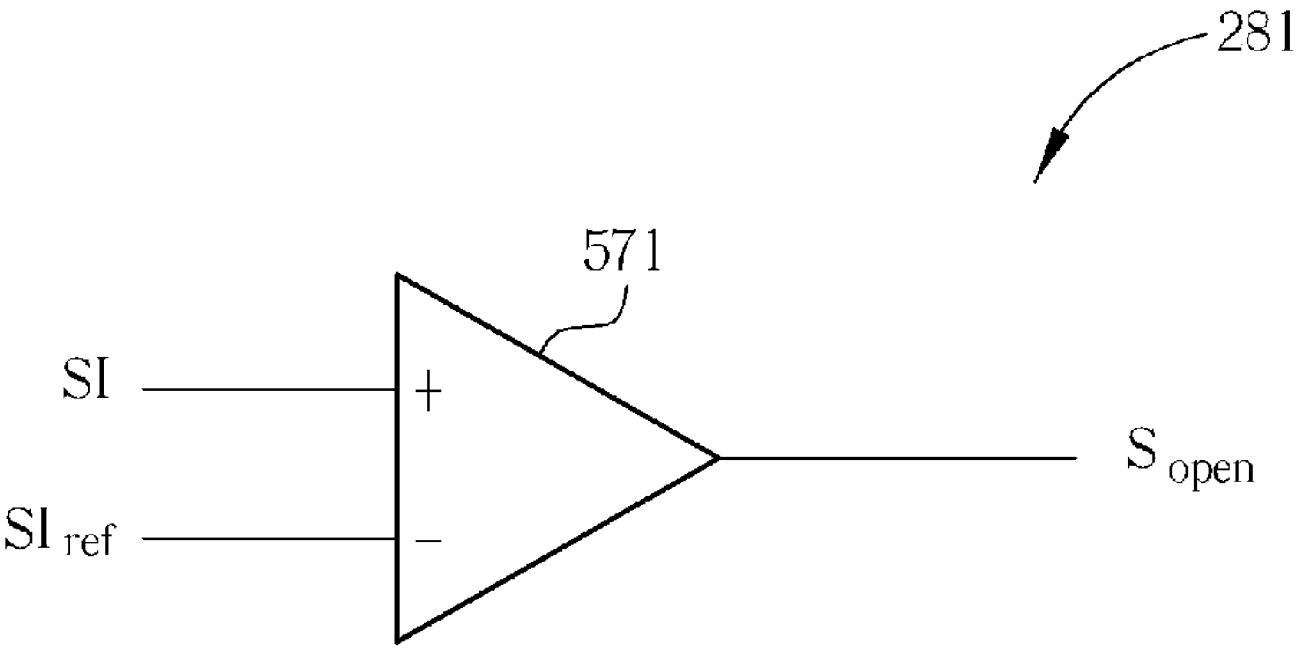
FIG. 4 is a schematic circuit diagram showing a preferred embodiment of the open-circuit detection circuit in FIG. 1.

FIG. 4 is a schematic circuit diagram showing a preferred embodiment of the open-circuit detection circuit in FIG. 1. As shown in FIG. 4, the open-circuit detection circuit 281 comprises a comparator 571. The comparator 571 comprises a positive input end for receiving one corresponding lamp current signal SI from the feedback circuit 230, a negative input end for receiving a lamp open-circuit reference signal SIref, and an output end for outputting an open-circuit detection signal Sopen. The lamp current signal SI can be a lamp front-end current signal or a lamp rear-end current signal. The lamp open-circuit reference signal SIref can be a default current reference signal or an adjustable current reference signal determined based on the recipe. Consequently, the open-circuit detection signal Sopen having low-level voltage indicates that the open-circuit defect of one corresponding attached lamp 205 is detected, or alternatively the corresponding connection port 215 is not attached with any lamp. In another embodiment, the positive and negative input ends of the comparator 571 are utilized for receiving the lamp open-circuit reference signal SIref and the lamp current signal SI respectively, and the open-circuit detection signal Sopen having high-level voltage indicates that the open-circuit defect of one corresponding attached lamp 205 is detected, or alternatively the corresponding connection port 215 is not attached with any lamp. It is noted that the micro-controller unit 250 will forward one corresponding turn-off signal to quit outputting the high-voltage driving signal of one corresponding connection port 215 for ensuring the safety of workers as soon as the corresponding connection port 215 is detected to be open-circuit.

Figure 5:
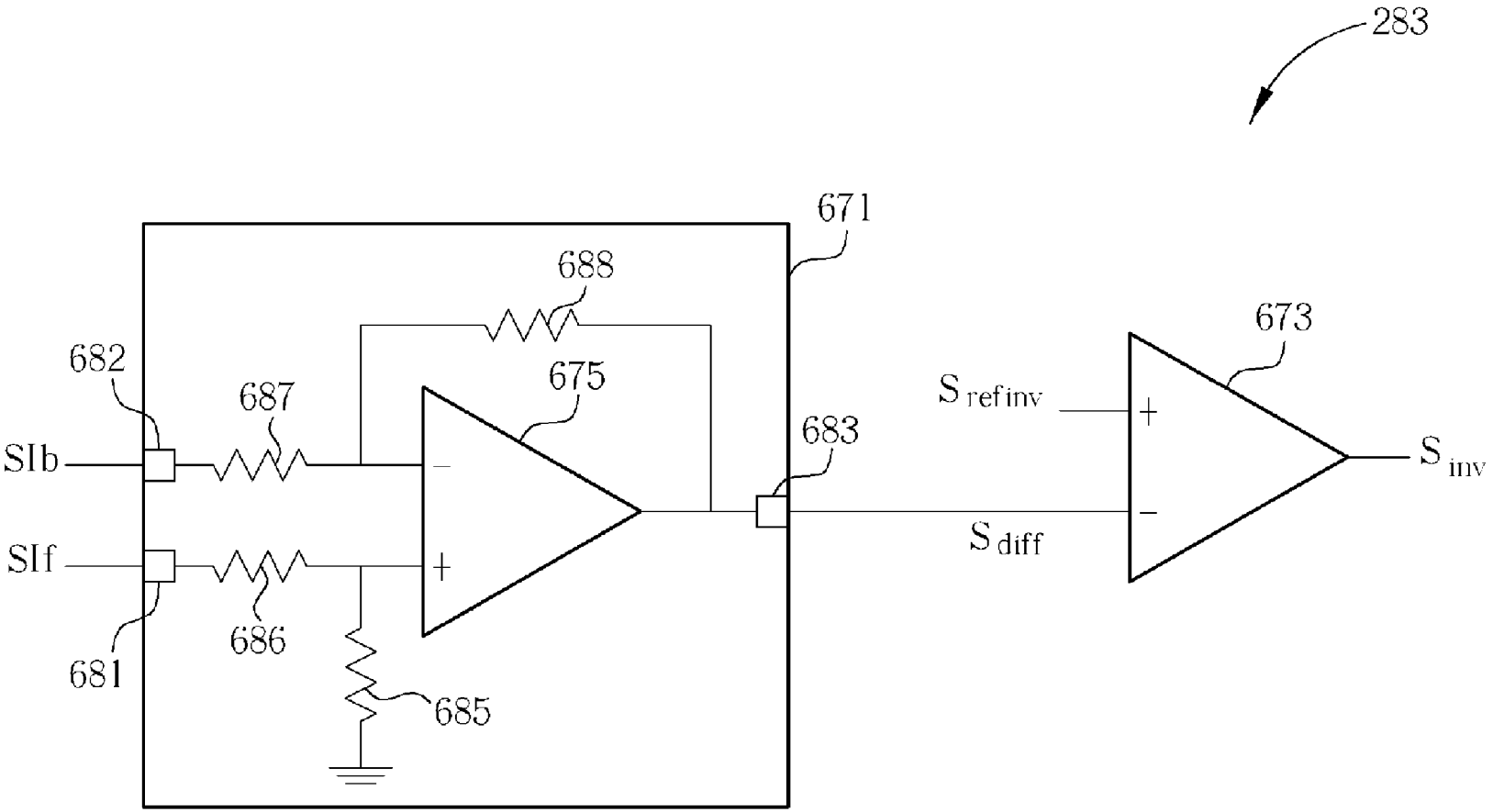
FIG. 5 is a schematic circuit diagram showing a preferred embodiment of the port reverse-connected detection circuit in FIG. 1.

FIG. 5 is a schematic circuit diagram showing a preferred embodiment of the port reverse-connected detection circuit in FIG. 1. As shown in FIG. 5, the port reverse-connected detection circuit 283 comprises a differential circuit 671 and a comparator 673. The differential circuit 671 comprises a first input end 681 for receiving one corresponding lamp front-end current signal SIf from the feedback circuit 230, a second input end 682 for receiving one corresponding lamp rear-end current signal SIb from the feedback circuit 230, an output end 683 for outputting a difference signal Sdiff, a plurality of resistors 685-688, and an operational amplifier 675. The resistors 685-688 and the operational amplifier 675 are arranged to become a well-known subtraction circuit. The positive and negative input ends of the operational amplifier 675 are respectively coupled to the first input end 681 and the second input end 682 so that the differential circuit 671 functions to generate the difference signal Sdiff by subtracting the lamp rear-end current signal SIb from the lamp front-end current signal SIf. In another embodiment, the differential circuit 671 can be a well-known instrumentation differential amplifier. The comparator 673 comprises a positive input end for receiving a reverse-connected detection reference signal Srefinv, a negative input end coupled to the output end 683 of the differential circuit 671 for receiving the difference signal Sdiff, and an output end for outputting the reverse-connected detection signal Sinv. The reverse-connected detection reference signal Srefinv can be a default reverse-connected detection reference signal or an adjustable reverse-connected detection reference signal determined based on the recipe. Consequently, the reverse-connected detection signal Sinv having low-level voltage indicates that the reverse-connected mal-operation of one corresponding connection port 215 is detected. In another embodiment, the positive and negative input ends of the comparator 673 are utilized for receiving the difference signal Sdiff and the reverse-connected detection reference signal Srefinv respectively, and the reverse-connected detection signal Sinv having high-level voltage indicates that the reverse-connected mal-operation of one corresponding connection port 215 is detected.

Figure 6:
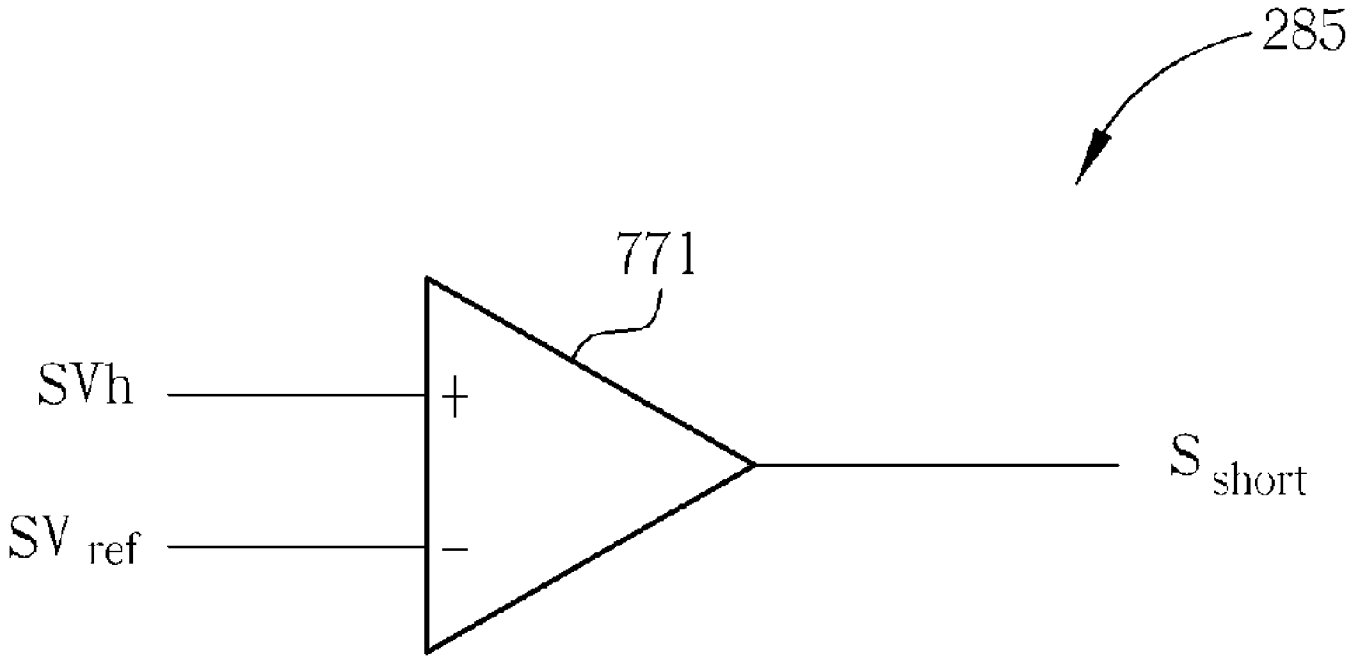
FIG. 6 is a schematic circuit diagram showing a preferred embodiment of the short-circuit detection circuit in FIG. 1.

FIG. 6 is a schematic circuit diagram showing a preferred embodiment of the short-circuit detection circuit in FIG. 1. As shown in FIG. 6, the short-circuit detection circuit 285 comprises a comparator 771. The comparator 771 comprises a positive input end for receiving one corresponding lamp front-end voltage signal SVh from the feedback circuit 230, a negative input end for receiving a lamp voltage reference signal SVref, and an output end for outputting an short-circuit detection signal Sshort. The lamp voltage reference signal SVref can be a default voltage reference signal or an adjustable voltage reference signal determined based on the recipe. Consequently, the short-circuit detection signal Sshort having low-level voltage indicates that the short-circuit defect of one corresponding attached lamp 205 is detected. In another embodiment, the positive and negative input ends of the comparator 771 are utilized for receiving the lamp voltage reference signal SVref and the lamp front-end voltage signal SVh respectively, and the short-circuit detection signal Sshort having high-level voltage indicates that the short-circuit defect of one corresponding attached lamp 205 is detected.

Figure 7:
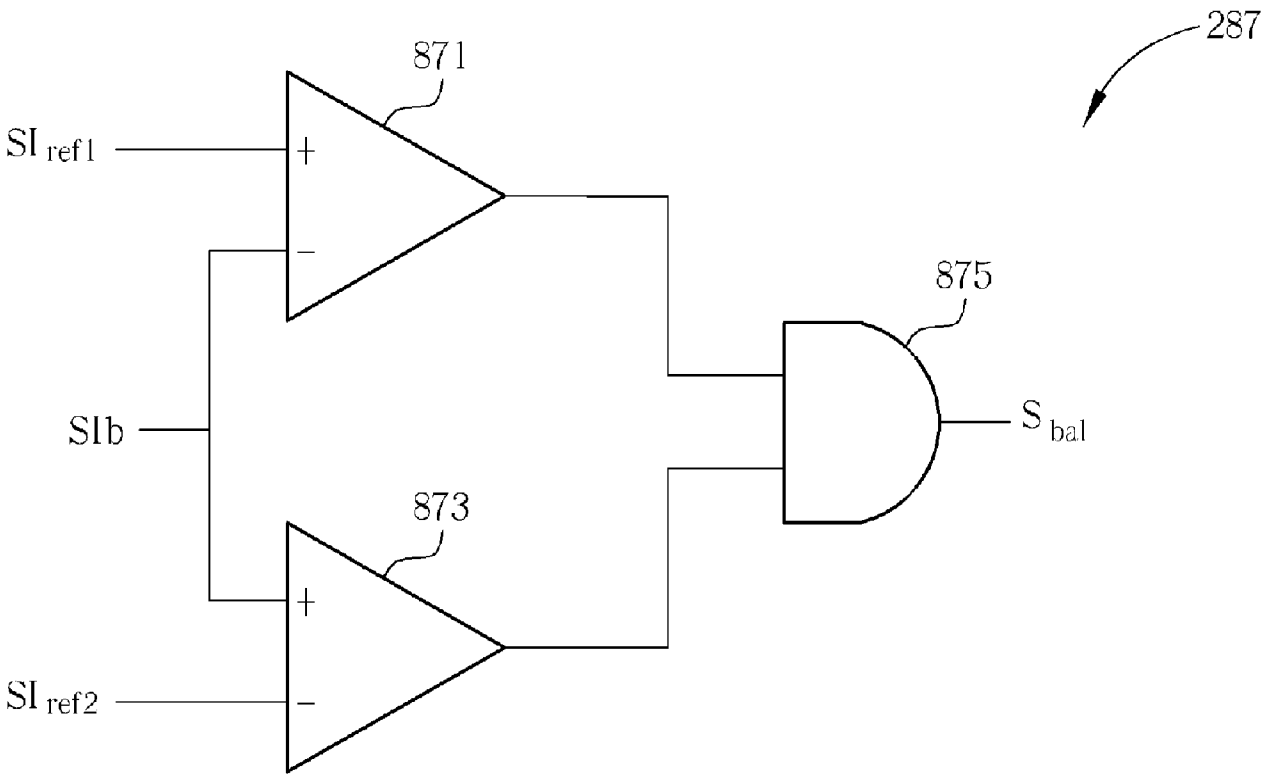
FIG. 7 is a schematic circuit diagram showing a preferred embodiment of the lamp-current balance detection circuit in FIG. 1.

FIG. 7 is a schematic circuit diagram showing a preferred embodiment of the lamp-current balance detection circuit in FIG. 1. As shown in FIG. 7, the lamp-current balance detection circuit 287 comprises a first comparator 871, a second comparator 873 and an AND gate 875. The first comparator 871 comprises a positive input end for receiving a high-current reference signal SIref1, a negative input end for receiving one corresponding lamp rear-end current signal SIb, and an output end. The high-current reference signal SIref1 can be a default high-current reference signal or an adjustable high-current reference signal determined based on the recipe. The second comparator 873 comprises a negative input end for receiving a low-current reference signal SIref2, a positive input end for receiving the corresponding lamp rear-end current signal SIb, and an output end. The low-current reference signal SIref2 can be a default low-current reference signal or an adjustable low-current reference signal determined based on the recipe. The AND gate 875 comprises a first input end coupled to the output end of the first comparator 871, a second input end coupled to the output end of the second comparator 873, and an output end for outputting a lamp-current balance detection signal Sbal. When the value of the lamp rear-end current signal SIb falls into a range between the values of the high-current reference signal SIref1 and the low-current reference signal SIref2, the lamp-current balance detection circuit 287 outputs the lamp-current balance detection signal Sbal having high voltage level, which indicates that the corresponding lamp 205 is working under lamp-current balance situation. On the contrary, the lamp-current balance detection signal Sbal having low voltage level indicates that the corresponding lamp 205 is working under lamp-current unbalance situation, which may be caused by a crack occurring to the corresponding lamp 205.

Figure 8:
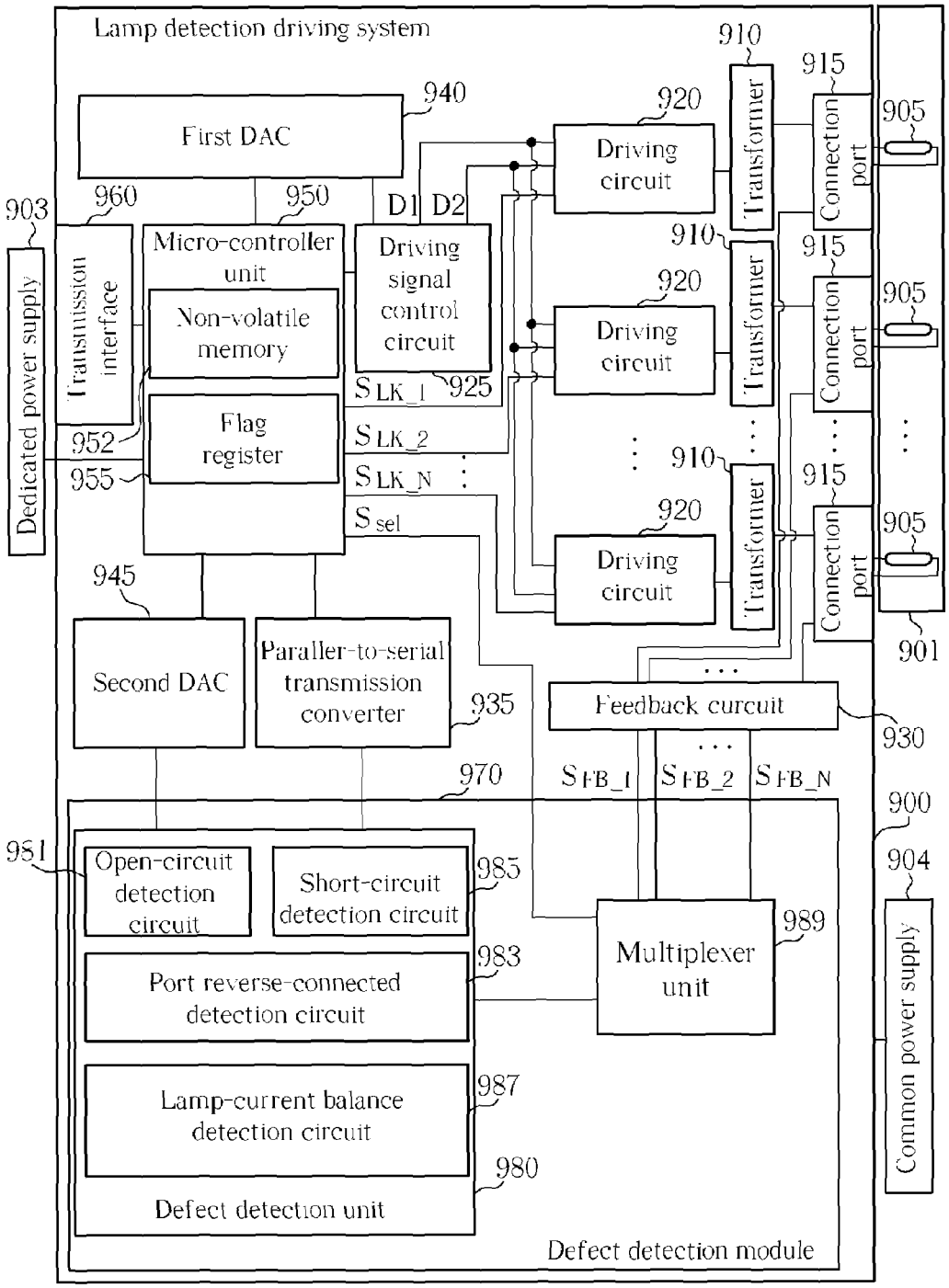
FIG. 8 is a schematic diagram showing a lamp detection driving system in accordance with a second embodiment of the present invention.

FIG. 8 is a schematic diagram showing a lamp detection driving system in accordance with a second embodiment of the present invention. As shown in FIG. 8, the lamp detection driving system 900 functions to detect a lighting module 901 having at least one lamp 905. The lamp 905 can be a cold-cathode fluorescent lamp or an external electrode fluorescent lamp. The lamp detection driving system 900 comprises a micro-controller unit 950, a driving signal control circuit 925, a plurality of driving circuits 920, a plurality of transformers 910, a plurality of connection ports 915, a transmission interface 960, a first DAC 940, a second DAC 945, a feedback circuit 930, a parallel-to-serial transmission converter 935, and a defect detection module 970. The micro-controller unit 950 comprises a non-volatile memory 952 and a flag register 955. The non-volatile memory 952 can be an electrically-erasable programmable read only memory or a flash memory. The defect detection module 970 comprises a defect detection unit 980 and a multiplexer unit 989. The defect detection unit 980 comprises an open-circuit detection circuit 981, a port reverse-connected detection circuit 983, a short-circuit detection circuit 985, and a lamp-current balance detection circuit 987.

The transmission interface 960 can be an I2C transmission interface or a universal asynchronous receiver/transmitter. The micro-controller unit 950 is coupled to the transmission interface 960 for downloading a recipe via an I2C transmission line or via a UART-based transmission line. The recipe is stored in the non-volatile memory 952. The micro-controller unit 950 is able to generate a PWM signal, a plurality of detection reference signals, and a lamp current control signal based on the recipe. Also, the micro-controller unit 950 is able to switch the flag value of the flag register 955 and enable a plurality of turn-off signals $S_{LK_1}$-$S_{LK_N}$ when some defect is detected. Furthermore, based on a lighting stable time provided by the recipe, the micro-controller unit 950 can be utilized to perform a delay process in the lamp detection operation. Moreover, the recipe may also provide a preset attached-lamp quantity for the micro-controller unit 950 to determine whether there is any lamp open-circuit defect detected according to the quantity of detected working lamps and the preset attached-lamp quantity. The flag register 955 is utilized for storing a flag value corresponding to the detection result regarding the lighting module 901. Accordingly, the flag value of the flag register 955 can be used to indicate whether there is any defect detected. In one embodiment, the micro-controller unit 950 is powered by a dedicated power supply 903, and the other elements of the lamp detection driving system 900 are powered by a common power supply 904 as shown in FIG. 8. In another embodiment, the micro-controller unit 950 and the other elements of the lamp detection driving system 900 are all powered by the common power supply 904. The micro-controller unit 950 further generates a selection signal Ssel forwarded to the multiplexer unit 989.

The multiplexer unit 989 is coupled to the feedback circuit 930 for receiving a plurality of sets of feedback signals $S_{FB_1}$, $S_{FB_2}$-$S_{FB_N}$. Also the multiplexer unit 989 is coupled to the micro-controller unit 950 for receiving the selection signal Ssel. The multiplexer unit 989 is utilized for transferring one corresponding set of feedback signals to the defect detection unit 980 based on the selection signal Ssel. That is, the plurality of sets of feedback signals $S_{FB_1}$, $S_{FB_2}$-$S_{FB_N}$ are sequentially transferred from the multiplexer unit 989 to the defect detection unit 980, and therefore the defect detection unit 980 generates a plurality of sets of detection signals regarding the lamps 905 through performing related signal processing operations on the plurality of sets of feedback signals $S_{FB_1}$, $S_{FB_2}$-$S_{FB_N}$ sequentially. In view of that, the plurality of sets of detection signals are also sequentially transferred from the defect detection unit 980 to the micro-controller unit 950 for analyzing. The other structures of the lamp detection driving system 900 are identical to those of the lamp detection driving system 200, and for the sake of brevity, further similar discussion thereof is omitted.

Figure 9:
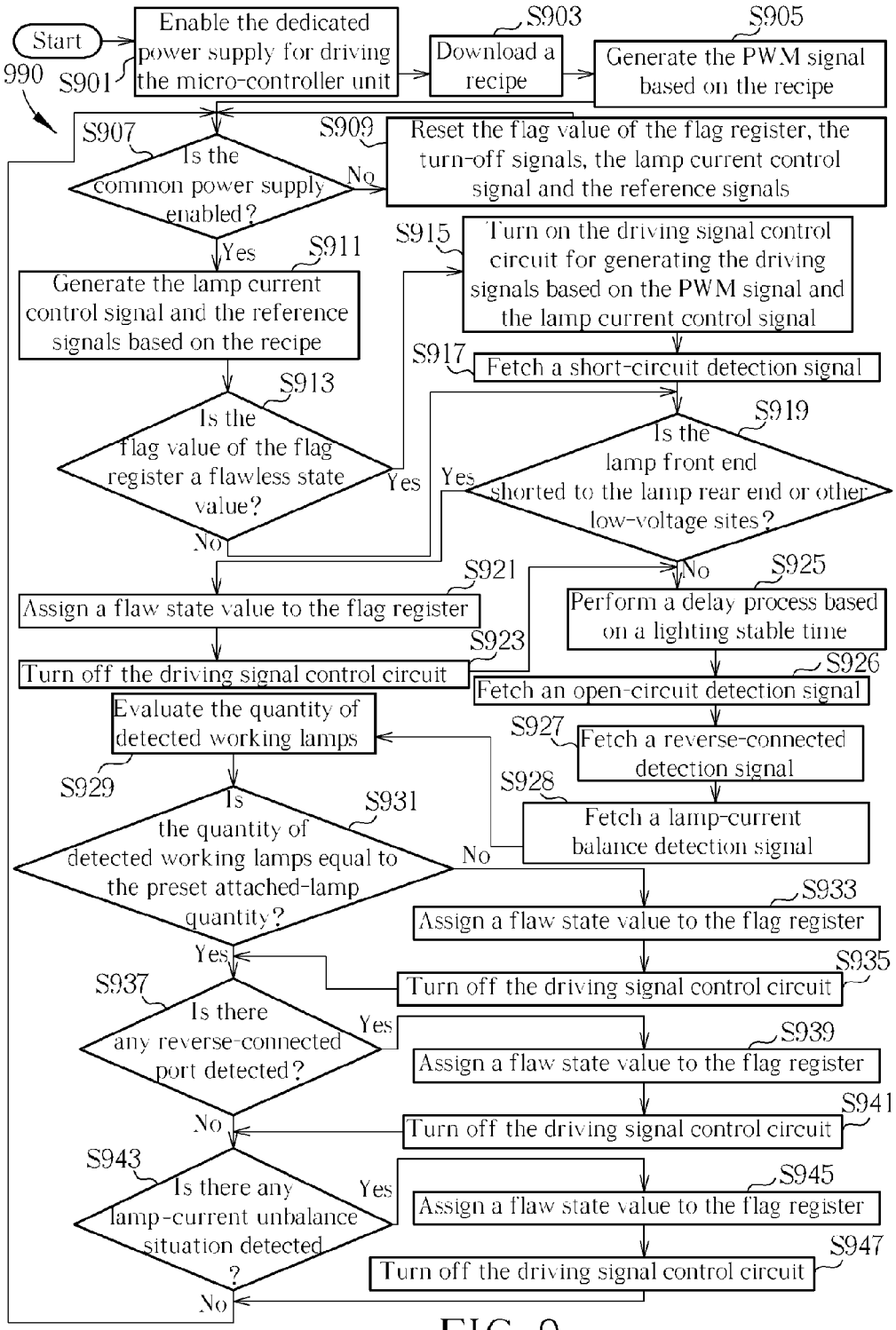
FIG. 9 is a flowchart depicting a lamp detection driving method regarding the operation of the lamp detection driving system in FIG. 1.

FIG. 9 is a flowchart depicting a lamp detection driving method regarding the operation of the lamp detection driving system in FIG. 1. As shown in FIG. 9, the lamp detection driving method 990 comprises the following steps:

Step S901: enable the dedicated power supply 203 for driving the micro-controller unit 250 to perform an initialization process;

Step S903: download a recipe to the non-volatile memory 252 of the micro-controller unit 250;

Step S905: generate the PWM signal based on the recipe by the micro-controller unit 250 and forward the PWM signal to the driving signal control circuit 225;

Step S907: determine whether the common power supply 204 is enabled for powering other elements of the lamp detection driving system 200 by the micro-controller unit 250, if the common power supply 204 is enabled for powering the lamp detection driving system 200, then go to step S911, otherwise go to step S909;

Step S909: reset the flag value of the flag register 255 and the turn-off signals $S_{LK_1}$-$S_{LK_N}$ to be a flawless state value and disable signals respectively, and reset the lamp current control signal and the detection reference signals to be null by the micro-controller unit 250, go to step S907;

Step S911: generate the lamp current control signal, the voltage reference signal, the lamp open-circuit reference signal, the reverse-connected detection reference signal, the high-current reference signal and the low-current reference signal based on the recipe by the micro-controller unit 250;

Step S913: determine whether the flag value of the flag register 255 is a flawless state value, if the flag value of the flag register 255 is a flawless state value, then go to step S915, otherwise go to step S919;

Step S915: turn on the driving signal control circuit 225 so that the lamp detection driving system 200 is able to generate the driving signals based on the PWM signal and the lamp current control signal, the driving signals being outputted via the connection ports 215 respectively;

Step S917: fetch a short-circuit detection signal generated through performing a short-circuit detection process by the defect detection module 270 based on the voltage reference signal and the lamp front-end voltage signal furnished from the feedback circuit 230;

Step S919: determine whether the lamp front end is shorted to the lamp rear end or other low-voltage sites based on the short-circuit detection signal by the micro-controller unit 250, if the lamp front end is shorted to the lamp rear end or other low-voltage sites, then go to step S921, otherwise go to step S925;

Step S921: assign a flaw state value to the flag value of the flag register 255;

Step S923: turn off the driving signal control circuit 225, go to step S925;

Step S925: perform a delay process based on a lighting stable time provided by the recipe or a default lighting stable time by the micro-controller unit 250;

Step S926: fetch an open-circuit detection signal generated through performing an open-circuit detection process by the defect detection module 270 based on the lamp open-circuit reference signal and the lamp rear-end or front-end current signal furnished from the feedback circuit 230;

Step S927: fetch a reverse-connected detection signal generated through performing a port reverse-connected detection process by the defect detection module 270 based on the reverse-connected detection reference signal and the lamp rear-end and front-end current signals furnished from the feedback circuit 230;

Step S928: fetch a lamp-current balance detection signal generated through performing a lamp-current balance detection process by the defect detection module 270 based on the high-current reference signal, the low-current reference signal, and the lamp rear-end current signal furnished from the feedback circuit 230;

Step S929: evaluate the quantity of detected working lamps based on the open-circuit detection signal and enable the corresponding turn-off signal for turning off the corresponding driving circuit 220 by the micro-controller unit 250 so as to quit forwarding the high-voltage driving signal to the open-circuit connection port 215;

Step S931: compare the quantity of detected working lamps with the preset attached-lamp quantity of the recipe by the micro-controller unit 250 for determining whether there is any lamp open-circuit defect detected, if the quantity of detected working lamps and the preset attached-lamp quantity are equal, then go to step S937, otherwise go to step S933;

Step S933: assign a flaw state value to the flag value of the flag register 255;

Step S935: turn off the driving signal control circuit 225, go to step S937;

Step S937: determine whether there is any reverse-connected port detected based on the reverse-connected detection signal by the micro-controller unit 250, if there is at least one reverse-connected port detected, then go to step S939, otherwise go to step S943;

Step S939: assign a flaw state value to the flag value of the flag register 255;

Step S941: turn off the driving signal control circuit 225, go to step S943;

Step S943: determine whether there is any lamp-current unbalance situation detected based on the lamp-current balance detection signal by the micro-controller unit 250, if there is at least one lamp-current unbalance situation detected, then go to step S945, otherwise go to step S907;

Step S945: assign a flaw state value to the flag value of the flag register 255; and Step S947: turn off the driving signal control circuit 225, go to step S907.

In the flow of the lamp detection driving method 990, if the micro-controller unit 250 and all other elements of the lamp detection driving system 200 are powered by the common power supply 204, then the process of step S901 can be replaced by the process of enabling the common power supply 204 for driving the lamp detection driving system 200 and performing an initialization process of the micro-controller unit 250, and the steps S907, S909 can be omitted, i.e. the step S911 is performed immediately after finishing the step S905. The process of step S903 may comprise downloading the recipe to the non-volatile memory 252 of the micro-controller unit 250 based on an interrupt scheme at any moment. In the process of step S917, the voltage reference signal is a default voltage reference signal or an adjustable voltage reference signal determined based on the recipe. In the process of step S926, the lamp open-circuit reference signal is a default current reference signal or an adjustable current reference signal determined based on the recipe. In the process of step S927, the reverse-connected detection reference signal is a default reverse-connected detection reference signal or an adjustable reverse-connected detection reference signal determined based on the recipe. In the process of step S928, the high-current reference signal is a default high-current reference signal or an adjustable high-current reference signal determined based on the recipe, and the low-current reference signal is a default low-current reference signal or an adjustable low-current reference signal determined based on the recipe.

In the process of step S925, the delay process functions to delay the execution of step S926 so that the open-circuit detection process, the port reverse-connected detection process and the lamp-current balance detection process can be performed after stabilizing the lighting of the lamps 205 for generating accurate detection signals. However, the short-circuit detection process of step S917 is able to generate an accurate short-circuit detection signal without stabilizing the lighting of the lamps 205, and therefore the short-circuit detection process of step S917 can be carried out prior to the delay process of step S925. In step S929, the process of enabling the corresponding turn-off signal to quit forwarding the high-voltage driving signal to the open-circuit connection port 215 functions to ensure the safety of workers while operating the lamp detection driving system 200.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A lamp detection driving system, comprising:

a micro-controller unit for providing a pulse width modulation (PWM) signal, a lamp current control signal and a plurality of detection reference signals based on a recipe;

a driving signal control circuit, electrically coupled to the micro-controller unit, for generating a plurality of preliminary control signals based on the PWM signal;

a plurality of driving circuits, electrically coupled to the driving signal control circuit, each of the driving circuits being utilized to generate a driving signal for driving a corresponding lamp based on the preliminary control signals;

a defect detection module, electrically coupled to the micro-controller unit, for generating a plurality of detection signals based on the detection reference signals and a plurality of feedback signals, wherein the defect detection module comprises a plurality of defect detection units, and each of the defect detection units further comprises:

an open-circuit detection circuit for generating an open-circuit detection signal of the detection signals based on a lamp current signal of the feedback signals and a lamp open-circuit reference signal, the lamp open-circuit reference signal being a default current reference signal or an adjustable current reference signal of the detection reference signals, the lamp current signal being a lamp rear-end current signal or a lamp front-end current signal;

a short-circuit detection circuit for generating a short-circuit detection signal of the detection signals based on a lamp front-end voltage signal of the feedback signals and a voltage reference signal, the voltage reference signal being a default voltage reference signal or an adjustable voltage reference signal of the detection reference signals;

a lamp-current balance detection circuit for generating a lamp-current balance detection signal of the detection signals based on the lamp rear-end current signal, a high-current reference signal and a low-current reference signal, the high-current reference signal being a default high-current reference signal or an adjustable high-current reference current of the detection reference signals, the low-current reference signal being a default low-current reference signal or an adjustable low-current reference current of the detection reference signals; and a port reverse-connected detection circuit for generating a reverse-connected detection signal of the detection signals based on the lamp rear-end current signal, the lamp front-end current signal and a reverse-connected detection reference signal, the reverse-connected detection reference signal being a default reverse-connected detection reference signal or an adjustable reverse-connected detection reference signal of the detection reference signals; and a feedback circuit, electrically coupled to the defect detection module, for generating the feedback signals based on at least one lamp current or at least one lamp voltage of at least one lamp.

2. The lamp detection driving system of claim 1, further comprising:

a digital-to-analog converter, electrically coupled between the micro-controller unit and the driving signal control circuit, for converting the lamp current control signal into an analog control signal;

wherein the driving signal control circuit generates the preliminary control signals based on the PWM signal and the analog control signal.

3. The lamp detection driving system of claim 2, further comprising:

a transmission interface, electrically coupled to the micro-controller unit, the transmission interface being an I2C (Inter-Integrated circuit) transmission interface or a universal asynchronous receiver/transmitter (UART).

4. The lamp detection driving system of claim 1, further comprising:

a digital-to-analog converter, electrically coupled between the micro-controller unit and the defect detection module, for converting the detection reference signals into a plurality of analog reference signals;

wherein the defect detection module generates the detection signals based on the analog reference signals and the feedback signals.

5. The lamp detection driving system of claim 1, further comprising:

a parallel-to-serial transmission converter, electrically coupled between the micro-controller unit and the defect detection module, for converting a parallel transmission of the detection signals received from the defect detection module into a serial transmission of the detection signals forwarded to the micro-controller unit.

6. The lamp detection driving system of claim 1, wherein the micro-controller unit comprises:

a flag register for storing a flag value, the flag value being determined based on at least one detection signal; and a non-volatile memory for storing the recipe;

wherein the non-volatile memory is an electrically-erasable programmable read only memory (EEPROM) or a flash memory.

7. The lamp detection driving system of claim 1, further comprising:

a transmission interface, electrically coupled to the micro-controller unit, the transmission interface being an I2C transmission interface or a universal asynchronous receiver/transmitter;

wherein the micro-controller unit downloads the recipe via the transmission interface.

8. The lamp detection driving system of claim 1, wherein the open-circuit detection circuit comprises:

a comparator comprising a first input end for receiving the lamp current signal, a second input end for receiving the lamp open-circuit reference signal, and an output end for outputting the open-circuit detection signal.

9. The lamp detection driving system of claim 1, wherein the short-circuit detection circuit comprises:

a comparator comprising a first input end for receiving the lamp front-end voltage signal, a second input end for receiving the voltage reference signal, and an output end for outputting the short-circuit detection signal.

10. The lamp detection driving system of claim 1, wherein the lamp-current balance detection circuit comprises:

a first comparator comprising a positive input end for receiving the high-current reference signal, a negative input end for receiving the lamp rear-end current signal, and an output end;

a second comparator comprising a positive input end for receiving the lamp rear-end current signal, a negative input end for receiving the low-current reference signal, and an output end; and an AND gate comprising a first input end electrically coupled to the output end of the first comparator, a second input end electrically coupled to the output end of the second comparator, and an output end for outputting the lamp-current balance detection signal.

11. The lamp detection driving system of claim 1, wherein the port reverse-connected detection circuit comprises:

a differential circuit comprising a first input end for receiving the lamp front-end current signal, a second input end for receiving the lamp rear-end current signal, and an output end for outputting a difference signal, the difference signal being generated by subtracting the lamp rear-end current signal from the lamp front-end current signal; and a comparator comprising a first input end for receiving the reverse-connected detection reference signal, a second input end electrically coupled to the output end of the differential circuit, and an output end for outputting the reverse-connected detection signal;

wherein the differential circuit is a subtraction circuit or an instrumentation differential amplifier.

12. The lamp detection driving system of claim 1, wherein each of the driving circuits comprises:

a preliminary driver, electrically coupled to the driving signal control circuit, for generating a plurality of driving control signals based on the preliminary control signals; and a converter, electrically coupled to the preliminary driver, for generating the driving signal based on the driving control signals;

wherein the converter is a full-bridge inverter, a half-bridge inverter, or a push-pull inverter.

13. The lamp detection driving system of claim 12, wherein the micro-controller unit further provides a plurality of turn-off signals, and each of the driving circuits further comprises:

a lamp driving turn-off circuit, electrically coupled to the micro-controller unit for receiving a corresponding turn-off signal of the turn-off signals, the lamp driving turn-off circuit being utilized for pulling down the preliminary control signals or the driving control signals to a ground level based on the corresponding turn-off signal.

14. The lamp detection driving system of claim 1, wherein the micro-controller unit is powered by a dedicated power supply.

15. The lamp detection driving system of claim 1, further comprising:

a plurality of transformers, each of the transformers being electrically coupled to a corresponding driving circuit of the driving circuits and being configured to transform a corresponding driving signal to a high-voltage driving signal for driving a corresponding lamp.

16. A lamp detection driving method, comprising:

downloading a recipe;

generating at least one driving signal for driving at least one lamp based on the recipe;

providing at least one detection reference signal for performing at least one defect detection process based on the recipe, the at least one detection reference signal comprising a lamp open-circuit reference signal, a voltage reference signal, a high-current reference signal, a low-current reference signal, or a reverse-connected detection reference signal;

performing an open-circuit detection process on a lamp current signal based on the lamp open-circuit reference signal or a default lamp open-circuit reference signal for generating an open-circuit detection signal, the lamp current signal being a lamp rear-end current signal or a lamp front-end current signal;

performing a short-circuit detection process on a lamp front-end voltage signal based on the voltage reference signal or a default voltage reference signal for generating a short-circuit detection signal;

performing a lamp-current balance detection process on the lam front-end or rear-end current signal based on the high-current reference signal or a default high-current reference signal and based on the low-current reference signal or a default low-current reference signal for generating a lamp-current balance detection signal; and performing a reverse-connected detection process on the lamp rear-end and front-end current signals based on the reverse-connected detection reference signal or a default reverse-connected detection reference signal for generating a reverse-connected detection signal.

17. The lamp detection driving method of claim 16, wherein generating the at least one driving signal for driving the at least one lamp based on the recipe comprises:

generating at least one driving control signal based on the recipe; and generating the at least one driving signal for driving the at least one lamp based on the at least one driving control signal.

18. The lamp detection driving method of claim 17, wherein generating the at least one driving control signal based on the recipe is generating a PWM signal and a lamp current control signal based on the recipe.

19. The lamp detection driving method of claim 18, wherein generating the at least one driving signal for driving the at least one lamp based on the at least one driving control signal is generating the at least one driving signal for driving the at least one lamp based on the PWM signal and the lamp current control signal.

20. The lamp detection driving method of claim 16, further comprising:

performing a delay process based on a default lighting stable time or a lighting stable time provided by the recipe after finishing the short-circuit detection process.

21. The lamp detection driving method of claim 16, further comprising:

performing a lamp driving turn-off process when a defect is detected after performing the at least one defect detection process.

* * * * *